US005257865A

United States Patent [19]

Tani

[11] Patent Number: 5,257,865

[45] Date of Patent: Nov. 2, 1993

[54] MOUTH STRUCTURE FOR A FLEXIBLE BAG

[76] Inventor: Kanari Tani, 21-16, Minamigaoka 2-chome, Ohnojo-shi, Fukuoka, Japan

[21] Appl. No.: 913,863

[22] Filed: Jul. 15, 1992

[30] Foreign Application Priority Data

Jan. 22, 1992 [JP] Japan ..... 4-009437

[51] Int. Cl.[5] ..... B65D 39/00; B65D 33/36

[52] U.S. Cl. ..... 383/78; 383/80; 383/906; 215/11.3

[58] Field of Search ..... 383/68, 78, 80, 906; 215/11.3, 11.6; 426/115, 117, 128; 222/105

[56] References Cited

U.S. PATENT DOCUMENTS 1,331,294 2/1920 Traynor ..... 383/80
2,520,335 8/1950 Piazze ..... 215/11.3
2,581,340 1/1952 Allen ..... 215/11.3
3,061,129 10/1962 Fitz Gerald ..... 215/11.3
5,156,299 10/1992 De Caluwe et al. ..... 222/105 X

FOREIGN PATENT DOCUMENTS 1287487 2/1962 France ..... 215/11.3

*Primary Examiner*—Gary E. Elkins
*Assistant Examiner*—Jes F. Pascua
*Attorney, Agent, or Firm*—Thomas R. Morrison

[57] ABSTRACT

A mouth structure comprises a mouth body to be fitted in the brim of an open flexible bag, and a mouth body fastening member for fastening the mouth body to the brim of the flexible bag. A spout is provided on the upper wall of the mouth body. The mouth structure is attached detachably to the open end of a flexible bag. The contents of the flexible bag need not be emptied into another container, and the flexible bag can be used as a container.

5 Claims, 7 Drawing Sheets

MOUTH STRUCTURE FOR A FLEXIBLE BAG

BACKGROUND OF THE INVENTION

The present invention relates to a mouth structure for a flexible bag, having a mouth body capable of being snapped on to the rim of the opening of a flexible bag to facilitate pouring out the contents of the flexible bag through the mouth body.

Synthetic resin containers capable of maintaining their shapes have been widely used for containing liquid detergent, shampoo and the like. Recently, there has been a growing trend toward the use of bags of flexible materials and bags formed of synthetic resin sheets in view of the facility of disposing of such bags.

Having thin walls and being capable of being folded up in a small volume, such bags contribute to resource conservation and to the reduction of the volume of wastes.

Generally, in using the contents of such a bag, the bag is cut open with scissors, and the contents are poured out through an opening formed by cutting the bag.

However, since the bag is flexible, it is difficult to pour the contents of the bag, and the contents remaining in the bag must be emptied into another rigid container for storage after the bag has been opened.

In emptying the contents of such a bag into another container, the contents must be poured carefully so that the contents may not spill, which requires troublesome work for emptying the contents of the bag into another container.

A flexible bag proposed to eliminate such disadvantages is provided with a cap having a mouth and welded to the opening of the flexible bag. However, it is possible that the flexible bags are broken by the mouths of the adjacent flexible bags during transportation and the contents of the flexible bags spill out. Furthermore, the volume of cases containing a plurality of flexible bags for transportation is increased inevitably by the rigid mouths of the flexible bags, and the firm mouths increase the volume of trash produced by collapsing the flexible bags.

Accordingly, it is an object of the present invention to provide a mouth structure for a flexible bag, capable of solving the foregoing problems.

SUMMARY OF THE INVENTION

The present invention provides a mouth structure for a flexible bag, comprising a hard mouth body to be fitted in the brim of a flexible bag, a mouth body fastening member for fastening the mouth body to the brim of the flexible bag and a spout provided on top of the mouth body.

The spout is a nozzle projecting from the upper wall of the mouth body.

The mouth structure of the present invention is characterized in that the mouth body fastening member has the shape of a cap consisting of a cylindrical side wall and an upper wall, the upper wall is provided in its central portion with an opening through which the spout projects, and the mouth body fastening member is split into a pair of symmetrical halves along a splitting line including the center line of the upper wall.

The mouth structure of the present invention is characterized in that the upper walls of the halves of the mouth body fastening member are connected along the split line by hinges so that the halves of the mouth body fastening member are able to turn relative to each other on the hinges in a vertical plane.

The mouth structure of the present invention is characterized in that the side walls of the halves of the mouth body fastening member are connected along the split line by hinges so that the halves are able to turn relative to each other on the hinges in a horizontal plane.

The mouth structure of the present invention is characterized in that the halves of the mouth body fastening member are provided in the edges of the side walls thereof with fastening means for fastening the halves to each other.

The mouth structure of the present invention is characterized in that the side wall of the mouth body has a substantially elliptical shape in a plan view.

The mouth structure of the present invention is characterized in that the side wall of each of the halves of the mouth body fastening member has an extension extending along the flexible bag so that the extremity thereof is level with or projecting slightly beyond the lower end of the flexible bag and serving as a support for supporting the flexible bag in an upright position.

According to the present invention, the upper end of a flexible bag is opened by a predetermined means, the mouth body having a shape substantially the same as that of the elliptical brim of the flexible bag is fitted in the brim of the flexible bag, and the brim is held between the mouth body and the mouth body fastening member so that the interior of the flexible bag communicates with the spout provided on the upper wall of the mouth body by means of the interior of the mouth body. Thus, the mouth structure for the flexible bag is attached to the brim of the flexible bag to enable the contents of the flexible bag to be poured out through the spout of the mouth body. Since the mouth body is fastened hermetically to the brim of the flexible bag by the mouth body fastening member, the contents of the flexible bag do not leak.

When the mouth structure of the present invention is attached to the flexible bag after opening the same, the contents of the flexible bag need not be emptied into another container, and the flexible bag serves as a container. Since the mouth structure can be removed from one flexible bag when the contents of the flexible bag are exhausted and put on another flexible bag and the empty flexible bag can be folded in a small volume into scrapping the flexible bag, the mouth structure contributes to resource conservation and to the reduction of the volume of wastes.

DETAILED DESCRIPTION OF THE PREFERRED EMBODIMENTS

Figure 1:
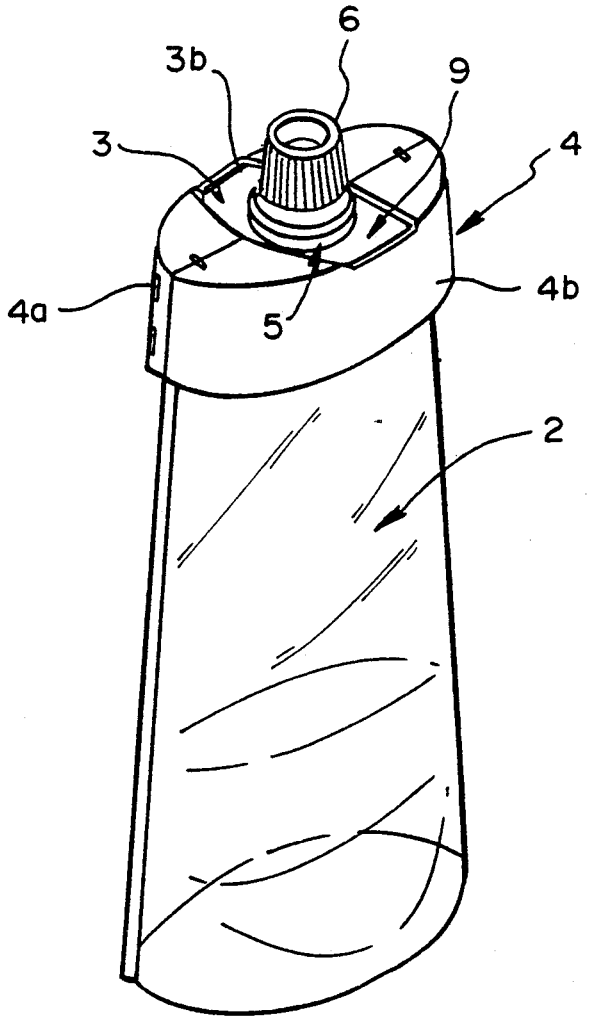
FIG. 1 is a perspective view of a mouth structure of the present invention for a flexible bag.

The present invention will be described in detail with reference to the accompanying drawings. FIG. 1 is a perspective view of a mouth structure 1 embodying the present invention as attached to a flexible bag 2 formed of a synthetic resin or a laminated sheet formed by coating a paper sheet with a plastic film. The construction of the mouth structure for a flexible bag will be described in detail hereinafter.

Figure 2:
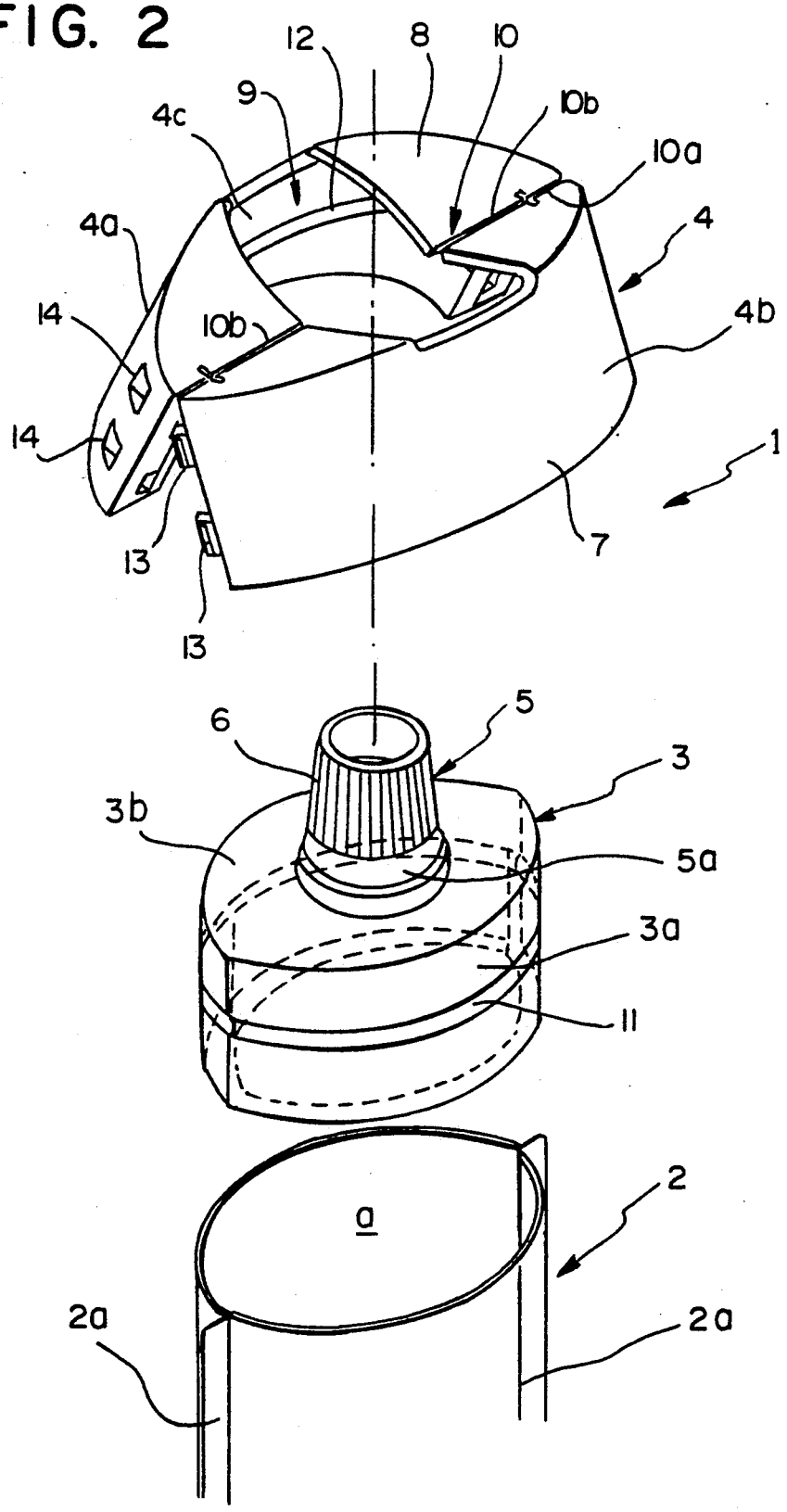
FIG. 2 is a perspective view of a mouth structure of the present invention.

Referring to FIG. 2, the mouth structure 1 comprises a hard mouth body 3 to be fitted in the brim 'a' of the flexible bag 2, and a mouth body fastening member 4 to be put on the mouth body 3 so as to fasten the brim 'a' of the flexible bag 2 between the circumference of the side wall 3*a* of the mouth body 3 and the mouth body fastening member 4. The mouth body 3 is provided on its upper wall with a spout 5.

Figure 3:
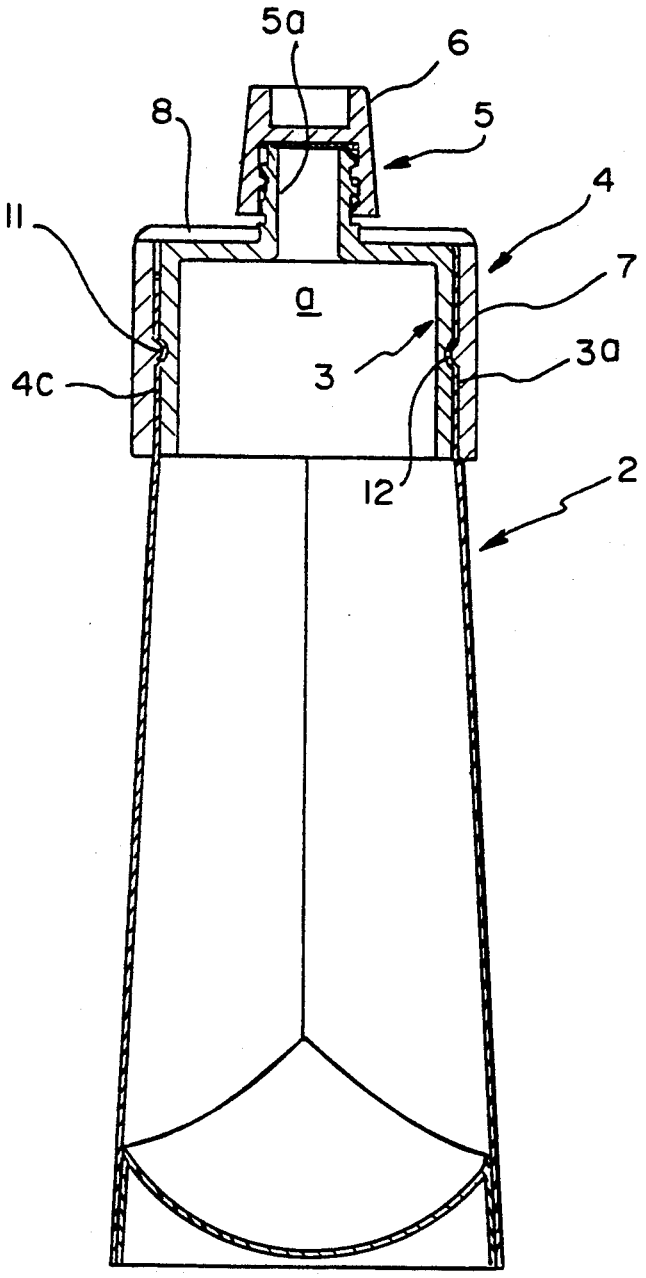
FIG. 3 is a sectional side view of the mouth structure for a flexible bag.

As shown in FIG. 3, the mouth body 3 is a tubular member with a closed upper end having a side wall 3*a* having a substantially elliptical shape corresponding to that of the brim 'a' of the flexible bag 2 in a plan view. The side wall 3*a* of the mouth body 3 is fitted in the brim 'a' of the flexible bag 2. A nozzle 5*a* forming a spout 5 projects from the upper wall 3*b* of the mouth body 3, and a cap 6 is screwed on the nozzle 5*a*. The contents of the flexible bag 2 are poured through the spout 5 into another container or the like.

Referring to FIGS. 2 and 3, the mouth body fastening member 4 has a side wall 7 having a substantially elliptical cross section and an upper wall 8. An opening 9 through which the nozzle 5*a* of the mouth body 3 projects is formed in the central portion of the upper wall 8 of the mouth body fastening member 4. As shown in FIG. 2, the mouth body fastening member 4 is split along a splitting line 10 including the center line of the upper wall 8 into a pair of symmetrical halves 4*a* and 4*b*. The thickness of a portion of the upper wall 8 along the upper splitting line 10*a* is reduced to form hinges 10*b* to connect the halves 4*a* and 4*b* so that the halves 4*a* and 4*b* are able to turn relative to each other on the hinges in a vertical plane.

In the first embodiment, an annular groove 11 and an annular ridge 12 fitting the annular groove 11 are formed respectively in the outer circumference of the side wall 3*a* of the mouth body 3 and the inner circumference of the side wall 4*c* of the mouth body fastening member 4 as shown in FIGS. 2 and 3. When the mouth body fastening member 4 is put on the mouth body 3, the annular ridge 12 fits in the annular groove 11 with the brim 'a' of the flexible bag 2 therebetween to fasten the mouth structure 1 firmly to the flexible bag 2.

Fastening hooks 13 are formed on the opposite side edges of the side wall of the right halve 4*b*, and holes 14 are formed in the side edges of the side wall of the left halve 4*a*. When the halves 4*a* and 4*b* are joined together, the fastening hooks 13 are fitted and caught in the holes 14, respectively, to fasten the halves 4*a* and 4*b* together so as to bind the brim 'a' of the flexible bag 2. The side edges 2*a* of the flexible bag 2 are held between the side edges of the side wall of the halves 4*a* and 4*b* to prevent the leakage of the contents through the junctions of the portions of the flexible bag 2 in the vicinity of the side edges 2*a* and the corresponding portion of the side wall of the mouth body 3.

In a modification, one side edge of the side wall of the half 4*a* and the corresponding side edge of the side wall of the half 4*b* are connected by a hinge formed along a portion of the splitting line corresponding to those side edges so that the halves 4*a* and 4*b* are able to turn relative to each other on the hinge in a horizontal plane, and a fastening structure for fastening together the pair of halves 4*a* and 4*b* is formed on those side edges of the pair of halves 4*a* and 4*b*.

A method of using the mouth structure 1 will be described hereinafter. In attaching the mouth structure 1 to the flexible bag 2, the upper end of the flexible bag 2 is cut open with scissors or the like, the mouth body 3 is fitted in the brim 'a' of the flexible bag 2, the pair of halves 4*a* and 4*b* are put on the mouth body 3, and then the pair of halves 4*a* and 4*b* are joined together to fasten the brim 'a' of the flexible bag 2 between the mouth body 3 and the mouth body fastening member 4. Then, the interior of the flexible bag 2 communicates with the spout 5 provided on the upper wall 3*b* of the mouth body 3 by means of the interior space of the mouth body 3. The contents of the flexible bag 2 is poured out through the spout 5.

The mouth structure 1 can easily be removed from the flexible bag 2. In scrapping the exhausted soft flexible bag 2, the fastening hooks 13 are disengaged to unfasten the halves 4*a* and 4*b*, the halves 4*a* and 4*b* are removed from the brim 'a' of the flexible bag 2, and the mouth body 3 is removed from the brim 'a' of the flexible bag 2. Only the flexible bag 2 is thrown away and the mouth structure 1 is used again in combination with another flexible bag 2.

When the mouth structure 1 of the present invention is connected to the open end of the flexible bag 2, the contents of the flexible bag 2 need not be emptied into another container and the flexible bag 2 can be used as a container. The mouth structure 1 is removed from the exhausted flexible bag 2 and used repeatedly in combination with other flexible bags, which contributes to resource conservation. Since the mouth structure 1 is removed from the flexible bag 2 before scrapping the flexible bag 2, the flexible bag 2 can be folded into a small volume for scrapping, which contributes to the reduction of the volume of wastes.

Figure 4:
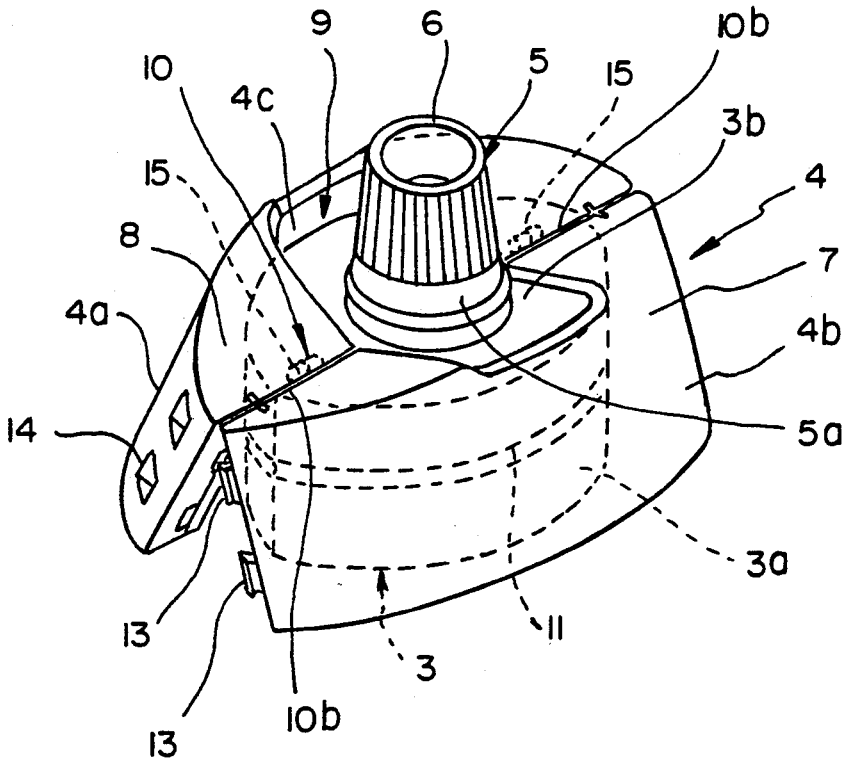
FIG. 4 is a perspective view of a modification of the mouth structure.

In a modification of the mouth structure 1, as shown in FIG. 4, the split halves 4*a* and 4*b* are joined to the upper wall 3*b* of the mouth body 3 by hinges 15. The mouth body 3 is fitted in the brim 'a' of the flexible bag 2, and then the halves 4*a* and 4*b* are fastened together to fasten the mouth body 3 to the flexible bag 2.

Since the split halves 4*a* and 4*b* are joined to the upper wall 3*b* of the mouth body 3 by the hinges 15, the mouth structure 1 can easily be fastened to the brim 'a' of the flexible bag 2 by fastening together the halves 4*a* and 4*b* after fitting the mouth body 3 in the brim 'a' of the flexible bag 2.

SECOND EMBODIMENT

Figure 5:
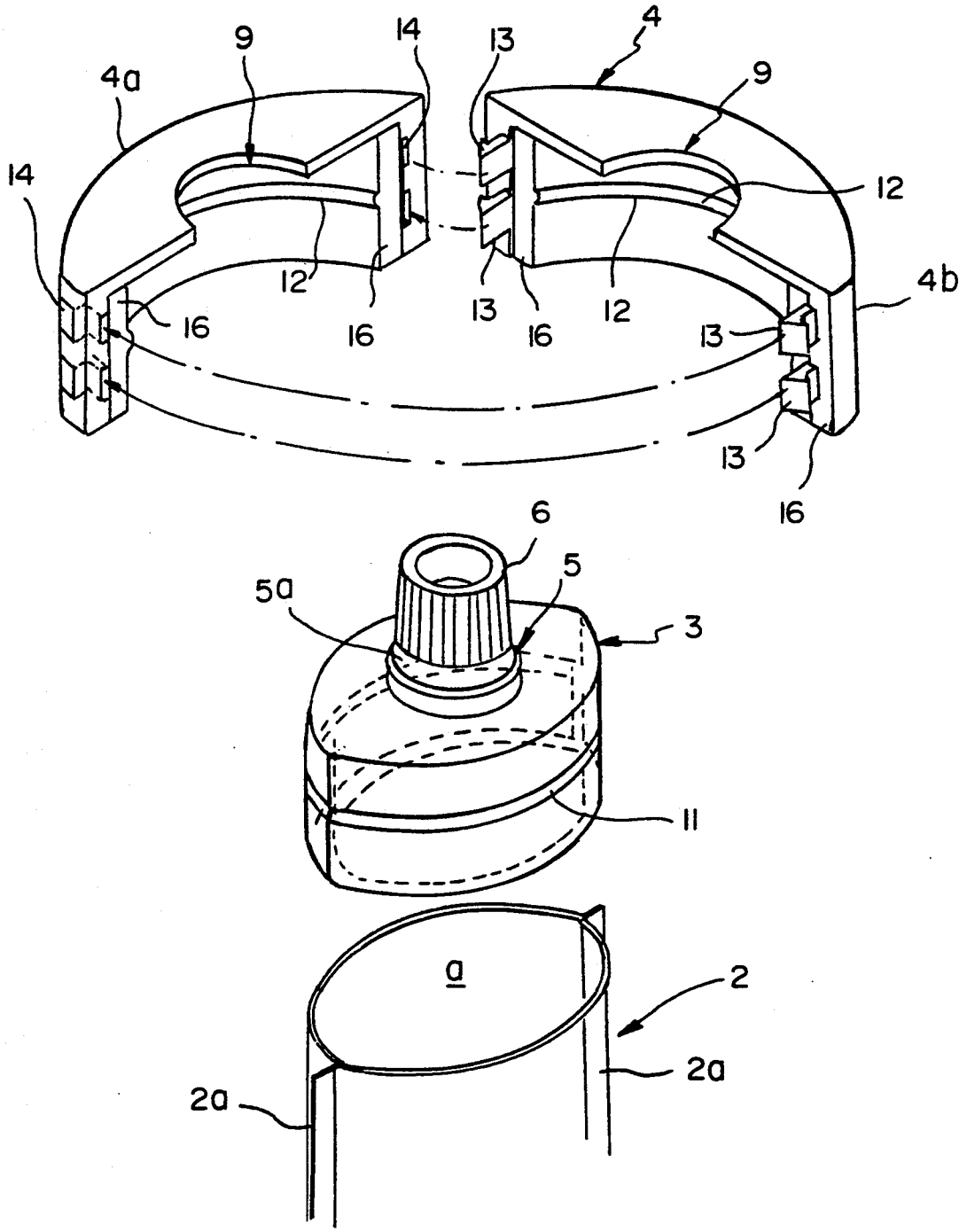
FIG. 5 is a perspective view of a mouth structure in a second embodiment according to the present invention.

Referring to FIG. 5 showing a mouth structure in a second embodiment according to the present invention, a mouth body fastening member 4 consists of a pair of halves 4*a* and 4*b* symmetrical with respect to a splitting line 10 including the center line of the upper wall 8 thereof. The right half 4*b* is provided on the opposite side edges of its side wall with fastening hooks 13, and the left half 4*a* is provided in the opposite side edges of its side wall with holes 14. The halves 4a and 4b are fastened together by engaging the hooks 13 and the holes 14. The upper wall 8 of the mouth body fastening member 4 facing the upper wall 3b of a mouth body 3 is provided with an opening 9 through which a nozzle 5a formed integrally with the mouth body 3 projects.

The mouth body 3 is fitted in the brim 'a' of a flexible bag 2, the halves 4a and 4b are placed on the opposite sides of the mouth body 3, and then the fastening hooks 13 and the holes 14 are engaged to fasten the brim 'a' of the flexible bag 2 between the mouth body 3 and the halves 4a and 4b.

Portions of the edges of the side walls of the pair of halves 4a and 4b, on the inner inside of the fastening hooks 13 and the holes 14 are recessed to form clamping surfaces 16 to clamp the side edges 2a of the flexible bag 2 between the corresponding clamping surfaces 16.

When the mouth structure 1 is connected to the brim 'a' of the flexible bag 2, the flexible bag 2 can be used as a container. The side edges 2a of the flexible bag 2 are clamped between the clamping surfaces 16 when the halves 4a and 4b are fastened together to prevent the leakage of the contents of the flexible bag 2.

THIRD EMBODIMENT

Figure 6:
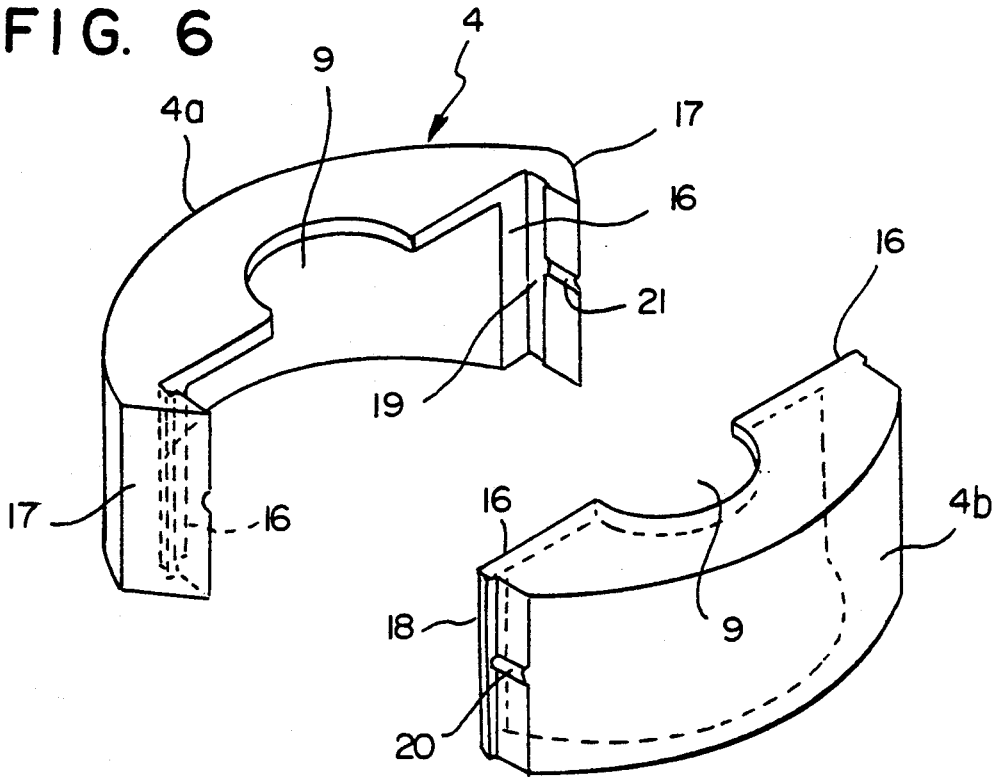
FIG. 6 is a perspective view of a mouth structure in a third embodiment according to the present invention.
Figure 7:
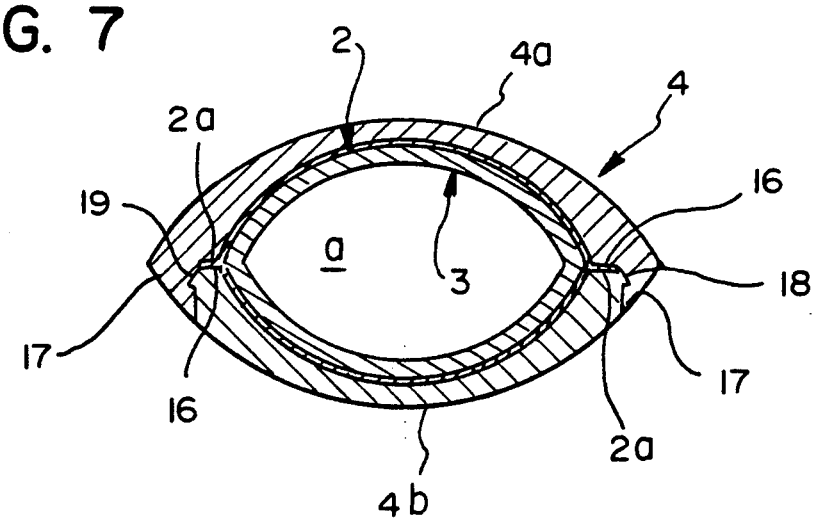
FIG. 7 is a plan view of the mouth structure of FIG. 6.

Referring to FIGS. 6 and 7 showing a mouth structure 1 in a third embodiment according to the present invention, a mouth body fastening member 4 is split into a pair of symmetrical halves 4a and 4b, ridges 17 are formed on the opposite edges of the side wall of the left half 4a, vertical grooves 19 are formed in the inner surfaces of the ridges 17, ridges 18 are formed on the opposite edges of the side wall of the right half 4b, and the ridges 18 of the right half 4b engage the vertical grooves 19 of the left half 4a when the halves 4a and 4b are joined together.

Horizontal grooves 21 are formed respectively in the inner surfaces of the ridges 17 of the left half 4a, and horizontal ridges 20 are formed respectively on the outer surfaces of the opposite edges of the side wall of the right half 4b. The horizontal ridges 20 fit into the horizontal grooves 21 when the pair of halves 4a and 4b are joined together.

When the mouth structure 1 is connected to the brim 'a' of a flexible bag 2, the flexible bag 2 can be used as a container. The engagement of the horizontal ridges 20 of the right half 4b and the horizontal grooves 21 of the left half 4a restrains the halves 4a and 4b from axial movement relative to the flexible bag 2 and fastens the mouth structure 1 firmly to the flexible bag 2.

FOURTH EMBODIMENT

Figure 8:
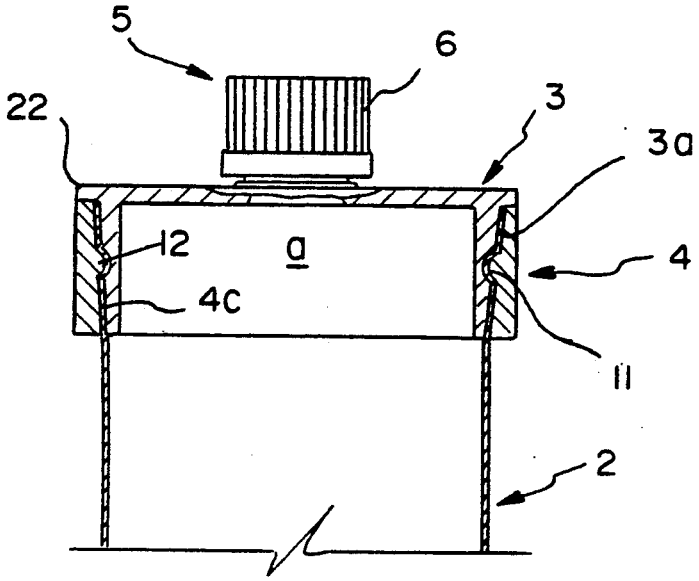
FIG. 8 is a sectional view of a mouth structure in a fouth embodiment according to the present invention.

Referring to FIG. 8 showing a mouth structure in a fourth embodiment according to the present invention, a mouth body 3 is provided at its upper end with a flange 22 and has a side wall having a tapered side wall 3a, and a tubular mouth body fastening member 4 has a side wall having a tapered inner surface 4c mating with the tapered outer side wall 3a of the mouth body 3. The side wall of the mouth body 3 fits into the mouth body fastening member 4. The brim 'a' of a flexible bag 2 is fastened between the mouth body 3 fitted therein and the mouth body fastening member 4 put on the mouth body 3.

When the mouth structure 1 is connected to the brim 'a' of the flexible bag 2, the flexible bag 2 can be used as a container. The engagement of the tapered side wall 3a of the mouth body 3 and the tapered inner surface 4c of the mouth body fastening member 4 fastens the mouth body 3 and the mouth body fastening member 4 firmly together, so that the mouth structure 1 does not come off the flexible bag 2 when the mouth body 3 is pulled up.

FIFTH EMBODIMENT

Figure 9:
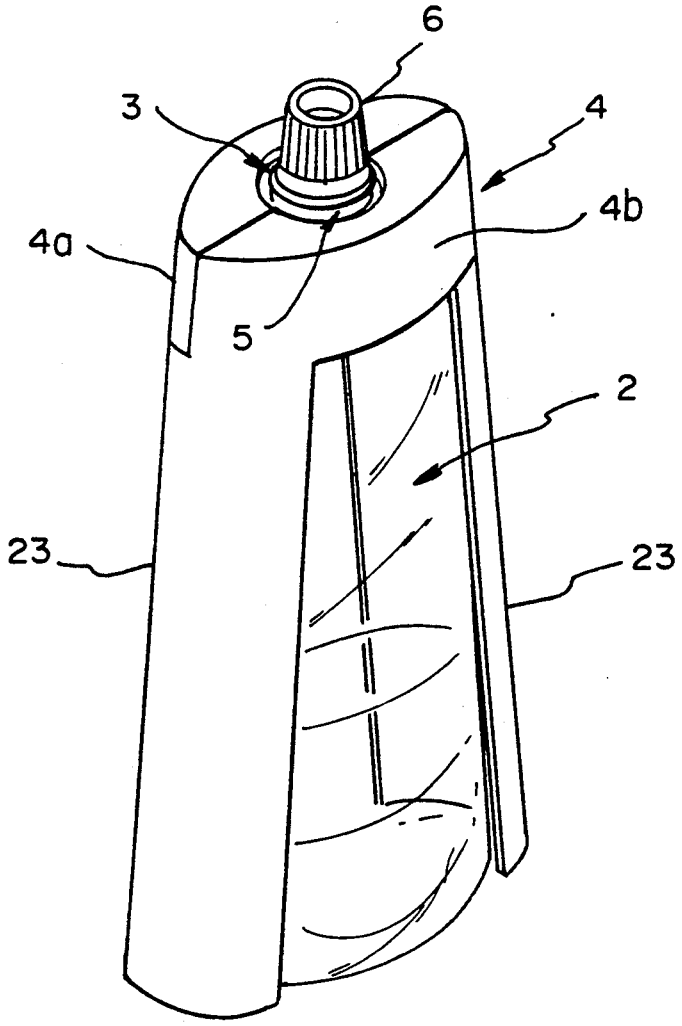
FIG. 9 is a perspective view of a mouth structure in a fifth embodiment according to the present invention.

A mouth structure 1 in the fifth embodiment according to the present invention is a modification of the mouth structure 1 in the fourth embodiment. Referring to FIG. 9, the mouth structure 1 has a mouth body fastening member 4 consisting of a pair of symmetrical halves 4a and 4b.

Portions of th side walls of the halves 4a and 4b are extended downward to form supports 23 for supporting a flexible bag 2 in an upright position even when the contents of the flexible bag 2 are reduced. The supports 23 are formed so that the extremities thereof are level with or projecting slightly beyond the lower end of the flexible bag 2.

As shown in FIG. 9, the supports 23 extend downward from the halves 4a and 4b of the mouth body fastening member 4 so as to diverge from the lower ends of the side walls of the halves 4a and 4b. The extremities of the supports 23 are substantially level with the lower end of the flexible bag 2. The supports 23 are curved gently so that the supports 23 fit the curved surface of the flexible bag 2.

When the mouth structure 1 is connected to the flexible bag 2, the divergent supports 23 extending on the opposite sides of the flexible bag 2 supports the flexible bag 2 in an upright position even when the contents of the flexible bag are reduced.

What is claimed is:

1. A mouth structure in combination with a flexible bag, comprising:

a hard mouth body fitted in an opening defined by a brim of said flexible bag;

a fastening member for fastening said mouth body to said brim;

a spout on a top surface of said mouth body;

said fastening member further comprising:

a cylindrical side wall; and an upper flat wall having an entire periphery thereof integrally connected to an upper peripheral end of said cylindrical side wall;

said upper flat wall having a central portion;

said central portion having an opening through which said spout projects;

said fastening member being capable of splitting into a pair of symmetrical halves along a splitting line;

said splitting line comprising:

a horizontal portion that bridges two points on a periphery of said upper flat wall and passes through a center thereof; and a pair of vertical portions on said side wall with upper ends thereof in alignment with said two points on said periphery of said upper flat wall.

2. A combination according to claim 1, wherein said pair of symmetrical halves are connected along said horizontal portion by hinges, whereby said symmetrical halves can rotate relative to each other on said hinges.

3. A combination according to claim 1, wherein said side wall has in plan view a shape substantially elliptical.

4. A combination according to claim 1, wherein said side wall has a plurality of circumferentially-spaced extrusions extending downward along said flexible bag so that extremities of said side wall are level with a lower end of said flexible bag, thereby serving to support said flexible bag in an upright position.

5. A combination according to claim 1, wherein said side wall has a plurality of circumferentially-spaced extrusions extending downward along said flexible bag so that extremities of said side wall project beyond a lower end of said flexible bag, thereby serving to support said flexible bag in an upright position.

* * * * *